US007866578B2

(12) United States Patent
Yasui et al.

(10) Patent No.: US 7,866,578 B2
(45) Date of Patent: Jan. 11, 2011

(54) FILM FORMING APPARATUS AND JETTING NOZZLE

(75) Inventors: Motohiro Yasui, Nagoya (JP); Jun Akedo, Tsukuba (JP)

(73) Assignees: Brother Kogyo Kabushiki Kaisha, Nagoya-shi, Aichi-ken (JP); National Institute of Advanced Industrial Science and Technology, Chiyoda-ku, Tokyo ( * ) Notice: Subject to any disclaimer, the term of this patent is extended or adjusted under 35 U.S.C. 154(b) by 565 days.

(21) Appl. No.: 11/467,039

(22) Filed: Aug. 24, 2006

(65) Prior Publication Data

US 2007/0051835 A1 Mar. 8, 2007

(30) Foreign Application Priority Data

Aug. 24, 2005 (JP) ..... 2005-243033

(51) Int. Cl.
*B05B 1/14* (2006.01)

(52) U.S. Cl. ..... 239/590.5; 239/590; 239/594; 239/518; 239/432; 239/433

(58) Field of Classification Search ..... 239/590, 239/594, 518, 432, 433; 131/194
See application file for complete search history.

(56) References Cited

U.S. PATENT DOCUMENTS

| | | | | |
|---|---|---|---|---|
| 22,574 | A * | 1/1859 | Ostrander | 239/590 |
| 2,562,930 | A | 8/1951 | Mapes | |
| 4,330,086 | A * | 5/1982 | Nysted | 239/8 |
| 4,844,344 | A * | 7/1989 | Manhardt et al. | 239/590 |
| 5,221,345 | A * | 6/1993 | Blankenship et al. | 118/63 |
| 6,036,116 | A * | 3/2000 | Bui | 239/432 |
| 2002/0100416 | A1 | 8/2002 | Sun et al. | |

FOREIGN PATENT DOCUMENTS

| | | | |
|---|---|---|---|
| DE | 9311886 | U1 | 9/1993 |
| EP | 0608176 | A1 | 7/1994 |
| EP | 1579921 | A2 | 9/2005 |
| GB | 557899 | A | 12/1943 |
| GB | 2096911 | A | 10/1982 |
| JP | 2001-348658 | * | 12/2001 |

(Continued)

OTHER PUBLICATIONS

European Patent Office, European Search Report for Related Application No. EP 06017586, dated May 2, 2007.

*Primary Examiner*—Dinh Q Nguyen
(74) *Attorney, Agent, or Firm*—Baker Botts, LLP

(57) ABSTRACT

A film forming apparatus includes an aerosol generating section which generates an aerosol; a jetting nozzle having an internal passage formed therein and through which the aerosol flows, the internal passage having one end serving as a supply port of the aerosol and having other end serving as a jetting port of the aerosol; a narrowed channel which is provided in the internal passage and which has a channel area narrower than a channel area on an upstream of the narrowed channel; and a collision portion which is provided in the internal passage on a downstream of the narrowed channel, and against which a flow of the aerosol passed through the narrowed channel collides. Since the aggregated particles are crushed and supplied from the jetting nozzle in the form of fine particles, a thin and uniform film can be formed on the process-objective material.

26 Claims, 9 Drawing Sheets

FOREIGN PATENT DOCUMENTS

| | | | |
|---|---|---|---|
| JP | 2003 293159 | | 10/2003 |
| WO | 91/03270 | A1 | 3/1991 |
| WO | 98/09731 | A1 | 3/1998 |
| WO | 99/55466 | A1 | 11/1999 |
| WO | 2005/042075 | A1 | 5/2005 |

* cited by examiner

FILM FORMING APPARATUS AND JETTING NOZZLE

CROSS REFERENCE TO RELATED APPLICATION

The present application claims priority from Japanese Patent Application No. 2005-243033, filed on Aug. 24, 2005, the disclosure of which is incorporated herein by reference in its entirety.

BACKGROUND OF THE INVENTION

1. Field of the Invention

The present invention relates to a film forming apparatus which forms a film of a ceramics material and a metallic material by using an AD (aerosol deposition) method, and a jetting nozzle used in the film forming apparatus.

2. Description of the Related Art

As a producing method of a piezoelectric film of a piezoelectric actuator used, for example, in an ink-jet head for an ink-jet printer or the like, a method called as an aerosol deposition method (AD method) is available. The AD method is a method of forming a piezoelectric film by jetting a substance (aerosol), in which fine particles of a piezoelectric material such as lead zirconate titanate (PZT) or the like is dispersed in a gas, toward a surface of a substrate such that the fine particles are collided and deposited onto the substrate. This producing method has been used not only for forming the film of a piezoelectric material, but also for forming a film of a ceramics material and a metallic material.

For example, in Japanese Patent Application Laid-open No. 2003-293159, an apparatus which performs a film formation by using such AD method is disclosed. This apparatus includes an aerosol forming chamber which generates an aerosol, a film forming chamber in which the aerosol generated is blown or jetted onto a substrate, and a nozzle which is provided inside the film forming chamber. The aerosol generated in the aerosol forming chamber is guided to the nozzle through a transporting pipe, and is jetted from the nozzle toward the substrate.

FIG. 9 shows a side cross-sectional view of a general nozzle 70 conventionally used in a film forming apparatus. The nozzle 70 as a whole is cylindrical shaped which is penetrated in a vertical direction, and an internal passage 71 through which the aerosol flows is formed inside the nozzle 70. An opening on a side of a lower end of the internal passage 71 defines a supply port 72 which is connected to the transporting pipe for the aerosol, and through which aerosol is received, and an opening on a side of an upper end of the internal passage 71 defines a jetting port 73 through which the aerosol is jetted. The aerosol enters from the supply port 72 into the nozzle 70, and flows upwardly through the internal passage 71, and is jetted from the jetting port 73 toward the substrate.

In some case, before particles in the aerosol are guided to such a nozzle, the particles are not reduced to sufficiently fine particles at a stage of aerosol generation, or the particles reduced to the fine particles are again aggregated while passing from the aerosol forming chamber to the nozzle, and are blown or sprayed onto the substrate in the form of aggregated particles having a large size. Since these aggregated particles have a large mass, collision energy at the time of colliding on the substrate is substantial, which in turn causes damage to the film and the like, thereby serving as a cause to hinder the formation of a thin and uniform film.

SUMMARY OF THE INVENTION

An object of the present invention is to provide a film forming apparatus which performs film forming by an AD method, and which enables to form a thin and uniform film According to a first aspect of the present invention, there is provided a film forming apparatus including:

an aerosol generating section which generates an aerosol by dispersing particulate material in a carrier gas;

a jetting nozzle having an internal passage which is formed in the jetting nozzle and through which the aerosol flows, the internal passage having one end defining a supply port which receives a supply of the aerosol from the aerosol generating section and having other end defining a jetting port from which the aerosol is jetted toward a process-objective material (material to be processed);

a narrowed channel which is provided in the internal passage and which has a channel area narrower than a channel area on an upstream of the narrowed channel; and a collision portion which is provided in the internal passage on a downstream of the narrowed channel, and against which a flow of the aerosol passed through the narrowed channel collides.

According to a second aspect of the present invention, there is provided a jetting nozzle usable in a film forming apparatus including an aerosol generating section which generates an aerosol by dispersing particulate material in a carrier gas, the jetting nozzle including:

an internal passage which is formed in the jetting nozzle and through which the aerosol flows, the internal passage having one end defining a supply port which receives a supply of the aerosol from the aerosol generating section and having other end defining a jetting port from which the aerosol is jetted toward a process-objective material;

a narrowed channel which is provided in the internal passage and which has a channel area narrower than a channel area on an upstream of the narrowed channel; and a collision portion which is provided in the internal passage on a downstream of the narrowed channel, and against which a flow of the aerosol passed through the narrowed channel collides.

In the film forming apparatus and the jetting nozzle of the present invention, the narrowed channel may be formed by providing an obstacle member, which obstructs the flow of the aerosol, in the internal passage.

In the film forming apparatus and the jetting nozzle of the present invention, a flow velocity of the aerosol, which has entered into the internal passage of the nozzle, is increased while passing through the narrowed channel, and the aerosol reaches the collision portion which is provided on the downstream of the narrowed channel. At this time, among particulate material (material particles) included in the aerosol, minute particles having a small mass are turned around a wall surface of the collision portion and flowed toward downstream of the flow of the aerosol, but aggregated particles having a comparatively larger mass cannot turn around the collision portion because of a large inertial force, and thus collide against the collision portion to be pulverized or crushed. Thus, the aggregated particles are crushed and are thus supplied from the nozzle in the form of fine particles. Therefore, it is possible to form a thin and uniform film on a process-objective material.

In the film forming apparatus of the present invention, a collision surface, of the collision portion, which faces the flow of the aerosol may be an inclined surface inclined with respect to a direction of the flow of the aerosol. In this case, it is possible to reduce problem or inconvenience such that the particles adhere to the collision surface due to excessively great collision energy of the particles, the particles deposit on the collision surface upon being blown due to stagnation of the aerosol, and the like.

In the film forming apparatus of the present invention, an angle of inclination of the collision surface may be 45° to 60° with respect to the direction of the flow of the aerosol. Here, it is preferable that the inclination angle of the collision surface is small to an extent that the above described problem can be suppressed. However, when the angle is too small, the collision energy of the aggregated particles with respect to the collision surface becomes small, and there is a fear that the particles are not crushed sufficiently. Consequently, it is preferable that the angle of the collision surface is made to be 45° to 60°.

In the film forming apparatus of the present invention, the channel area of the narrowed channel in the internal passage may be not more than 50% of a channel area at a position of the internal passage upstream of the narrowed channel. When the channel area is restricted in such a manner, it is possible to sufficiently accelerate the aerosol passing through the narrowed channel so as to make the aerosol collide against the collision surface with the collision energy sufficient to crush the aggregated particles.

In the film forming apparatus of the present invention, a throttle portion, at which a channel is narrowed toward the jetting port, may be provided in the internal passage on a downstream of the collision portion; and an opening area of the jetting port may be not more than ⅓ of a channel area of an inlet of the throttle portion. By narrowing the channel in the throttle portion in such a manner, it is possible to sufficiently accelerate the aerosol so as to impart, to the particulate material, the collision energy sufficient for firmly adhering to the process-objective material even when the flow of the aerosol is disturbed by the collision against the collision portion and the velocity is decreased.

In the film forming apparatus of the present invention, a facing surface, of the obstacle member, which faces the flow of the aerosol may be an inclined surface inclined with respect to a direction of the flow of the aerosol. Further, the facing surface may be an arc-shaped surface expanded toward upstream of the flow of the aerosol. Alternatively, the obstacle member may be column-shaped. By such configuration, it is possible to reduce problem or inconvenience such that the particles adhere to the facing surface due to excessively great collision energy of the particles, the particles deposit on the facing surface upon being blown due to stagnation of the aerosol, and the like.

In the film forming apparatus of the present invention, an angle of inclination of the facing surface may be 30° to 60° with respect to the direction of the flow of the aerosol. Here, it is preferable that the inclination angle of the facing surface is small to an extent that the above described problem can be suppressed. However, when the angle is too small, it is necessary to have a narrowing amount of the channel (internal passage) as required, in other words, since it is necessary to increase a length of the facing surface in a direction along the flow direction of the aerosol so as to secure a (sufficient) length in the facing surface in a direction intersecting the direction of the flow of the aerosol, which in turn requires the obstacle member to have a large size. Therefore, it is preferable that the inclination angle of the facing surface is made to be 30° to 60°.

In the film forming apparatus of the present invention, the obstacle member may be provided on a central axis line of the internal passage. In this case, the aerosol is advanced upon being turned around to some extent toward outer circumference of the obstacle member by passing around the obstacle member disposed in the central axis line of the internal passage, and the aerosol collides against the inner-wall surface of the internal passage at the downstream of the obstacle member. According to such a structure, since the inner-wall surface of the internal passage can be used as the collision portion, it is possible to avoid complicating the structure of the jetting nozzle.

In the film forming apparatus and the jetting nozzle of the present invention, the jetting port may be formed in a slit shape, and the obstacle member may be formed along a longitudinal direction of the jetting port. Alternatively, in the film forming apparatus of the present invention, the jetting port may be formed in a slit shape, and a supporting member supporting the obstacle member may be extended in a longitudinal direction of the jetting port. According to this structure, since any variation in the flow of the aerosol hardly occurs over the entire length in the longitudinal direction of the slit, it is possible to form a uniform film.

In the film forming apparatus of the present invention, the obstacle member may be provided at an inlet of the throttle portion, and the collision surface is an inner-wall surface of the throttle portion. In this case, since there is no need to provide the collision portion separately, it is possible to crush the aggregated particles while avoiding complication of the structure of the jetting nozzle, and to form a uniform film.

In the film forming apparatus of the present invention, an expanded portion, at which a channel area is widened than that of the narrowed channel, may be provided in the internal passage on the downstream of the narrowed channel. According to such structure, a turbulent flow is developed because the channel is suddenly widened at the expanded portion, and crushed fragments of the particles crushed by colliding against the collision portion are mixed. Accordingly, it is possible to make concentration of aerosol uniform, thereby forming a uniform film.

In the film forming apparatus of the present invention, an inner-wall surface of the internal passage, which surrounds the obstacle member, may be tapered toward downstream of the flow of the aerosol. In this case, the inner-wall surface formed to be taper shaped is made to be the collision portion, and an area of the internal passage on the upstream side becomes the expanded portion. Thus, it is possible to form the collision portion and the expanded portion by a single structure, namely the tapered inner-wall surface. Consequently, it is possible to crush the aggregated particles while avoiding complication of the structure of the jetting nozzle, and to form a uniform film.

In the film forming apparatus of the present invention, a surface roughness of the inner-wall surface of the internal passage may be not more than RZ 0.3 μm. By making the inner-wall surface to have a roughness of not less than a predetermined value, it is possible to suppress the adhesion of the particulate material to the inner-wall surface.

DETAILED DESCRIPTION OF THE PREFERRED EMBODIMENTS

First Embodiment

A first embodiment in which the present invention is embodied will be explained below with reference to FIG. 1 to FIG. 3.

Figure 1:
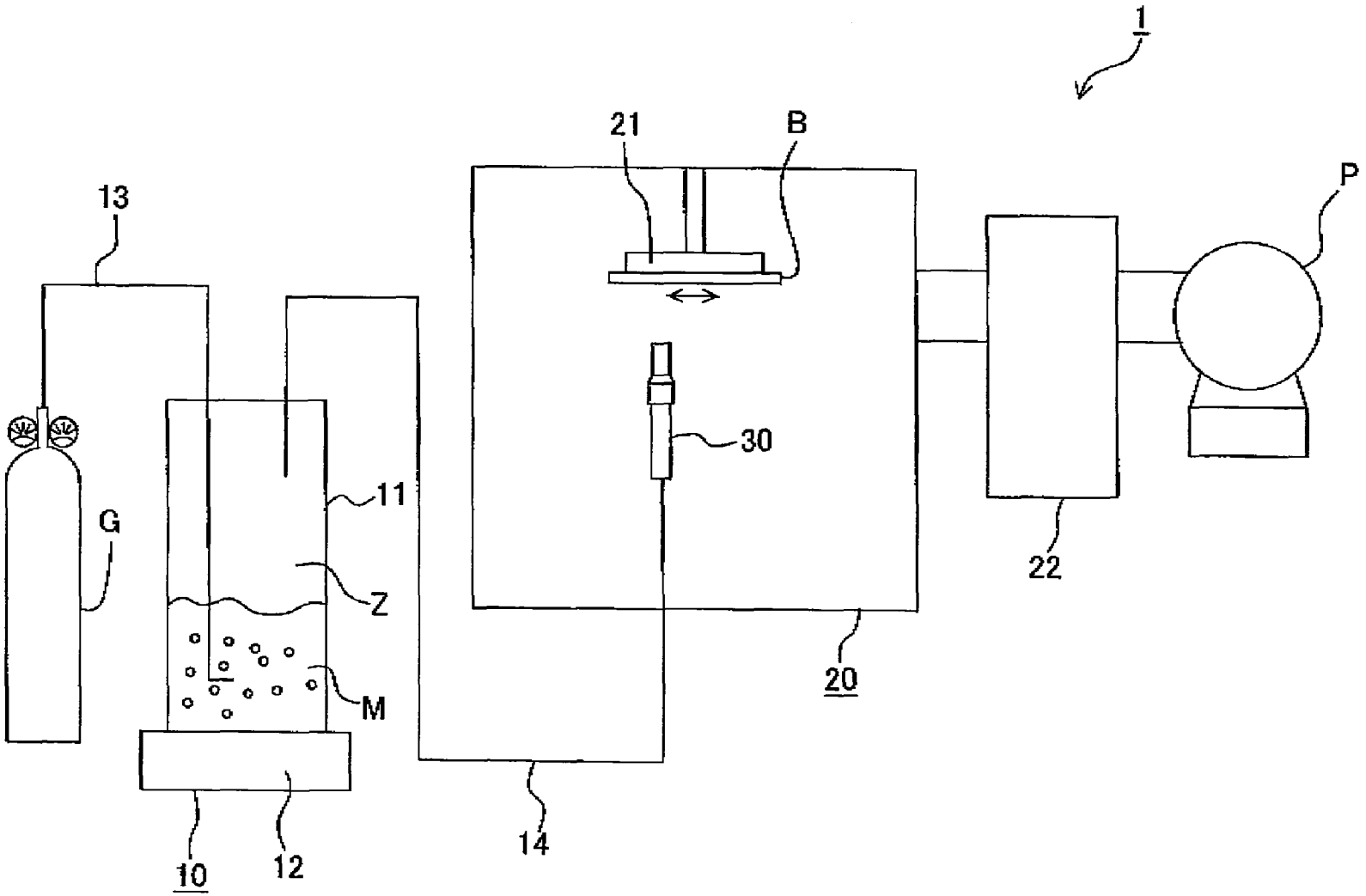
FIG. 1 is a schematic diagram of a film forming apparatus of a first embodiment.

FIG. 1 shows a schematic diagram of a film forming apparatus 1 in which the present invention is embodied. The film forming apparatus 1 includes an aerosol generator 10 which forms an aerosol Z by dispersing material particles (particulate material) M in a carrier gas, and a film forming chamber 20 in which the aerosol Z is jetted from a jetting nozzle 30 so as to make the material particles M in the aerosol Z to adhere to a substrate B (process-objective material).

The aerosol generator 10 includes an aerosol chamber 11 which is capable of accommodating the material particles M therein, and a vibration unit 12 which is attached to the aerosol chamber 11 and which causes the aerosol chamber 11 vibrate. A gas cylinder G for introducing the carrier gas is connected to the aerosol chamber 11 via an introduction pipe 13. An end of the introduction pipe 13 is positioned close to a bottom surface inside the aerosol chamber, and is buried in the material particles M. As the carrier gas, for example, inert gas such as helium, argon, and nitrogen, or a gas such as air and oxygen can be used.

The film forming chamber 20 includes a stage 21 to which the substrate B is attached, and a jetting nozzle 30 which is provided below the stage 21. A vacuum pump P is connected to the film forming chamber 20 via a powder recovery unit 22 such that the inside of the film forming chamber 20 can be decompressed.

Figure 2:
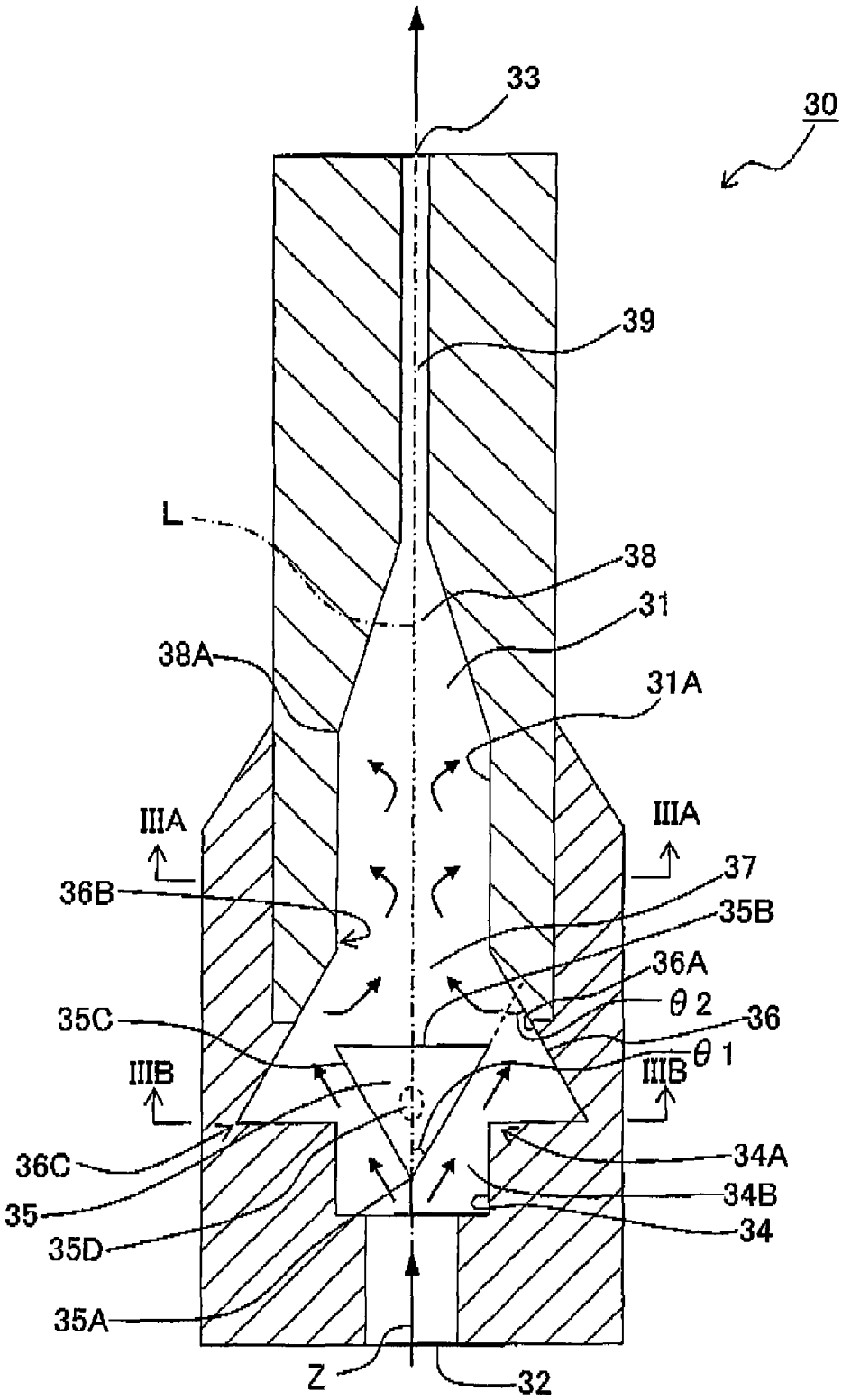
FIG. 2 is a side cross-sectional view of a jetting nozzle of the first embodiment.
Figure 3A:
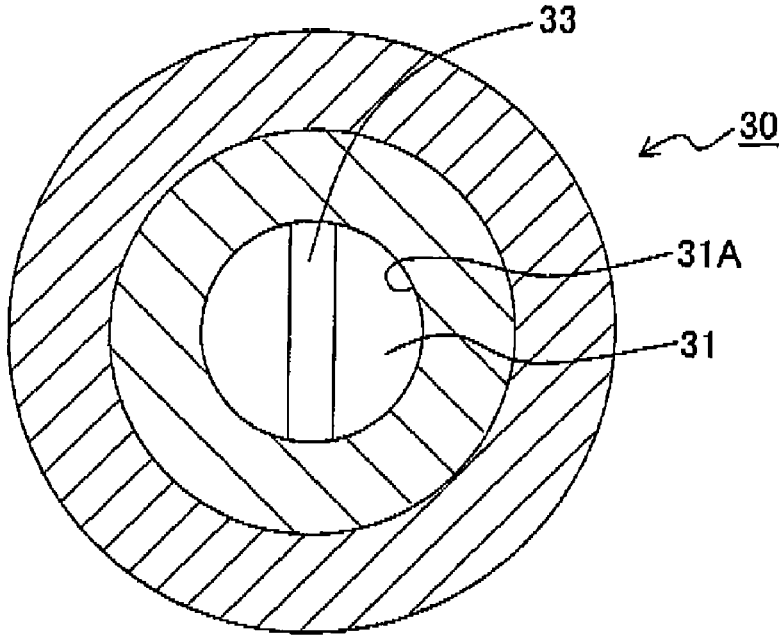
FIG. 3A is a cross-sectional view taken along a line IIIA-IIIA in FIG. 2.

As shown in FIG. 2, the jetting nozzle 30 as a whole is cylindrical shaped and is penetrated in a vertical direction, and an internal passage 31 through which the aerosol Z flows is formed inside the jetting nozzle 30. An opening on a side of a lower end of the internal passage 31 defines a supply port 32 which is connected to an aerosol supply pipe 14 and through which the aerosol Z is received. On the other hand, an opening on a side of an upper end of the internal passage 31 defines a jetting port 33 which is formed to be slit shaped and through which the aerosol Z is jetted. The jetting nozzle 30 is constructed such that a length from the supply port 32 up to the jetting port 33 is 70 mm to 100 mm. Further, the jetting port 33 is formed to be slit-shaped and having a length in the longitudinal direction of the jetting port 33 is 10 mm to 15 mm, and having a length in the short direction of the jetting port 33 is 0.2 mm to 0.5 mm. The aerosol Z, supplied from the aerosol chamber 11 via the aerosol supply pipe 14, enters into the jetting nozzle 30 from the supply port 31, flows upwardly in the internal passage 31, and is jetted from the jetting port 33 toward the substrate B.

A block 35 (obstacle, obstacle member) is provided in the internal passage 31, at a position somewhat above the supply port 32. It is preferable that the block 35 is formed of a nickel alloy or stainless steel, and is formed to be conical shaped, and a surface of the block 35 is coated with diamond-like carbon (DLC) considering the collision resistance. The block 35 is arranged such that an apex 35A of the cone is directed downwardly (toward upstream side), and that an axis connecting the apex 35A of the cone and a center point of a bottom surface 35B coincide with a central axis line L of the internal passage 31. Accordingly, a conical surface 35C (facing surface) of the block 35, which is a surface facing a flow of the aerosol Z is inclined with respect to a direction in which the aerosol Z flows (direction in which the jetting nozzle 30 is extended). An angle of inclination θ1 of a generating line forming the conical surface 35C is set to be in a range of 30° to 60° with respect to the direction of the flow of the aerosol Z (direction in which the central axis line L of the internal passage 31 is extended).

On the other hand, a tapered portion 36 which is tapered toward the downstream side (of the flow of the aerosol Z) is provided to a portion, which surrounds the obstacle member, on an inner-wall surface 31A of the internal passage 31. It is preferable that this tapered portion 36 is formed of a nickel alloy or stainless steel, and a surface of the tapered portion 36 is coated with diamond-like carbon (DLC) considering the collision resistance. A terminal end of the taper, in other words, a position of an end portion 36B on a small-diameter side is made to be located at a position somewhat downstream of a position corresponding to an end portion on a downstream of the block 35 (bottom surface 35B of the cone); and a leading end of the taper, namely a position of an end portion 36C on a large-diameter side is made to be located at a position downstream of the end portion of the bock 35 on the upstream side and located at a position upstream of the end portion of the block 35 on the downstream side (bottom surface 35B of the cone).

Further, a portion of the internal passage 31 on the upstream of the tapered portion 36 is made to be a straight pipe portion 34 having a diameter substantially same as a diameter of the end portion 36B on the small-diameter side of the tapered portion 36; and a position of an end portion 34A on the downstream of the straight pipe portion 34 coincides with a position of the end portion 36B on the upstream of the tapered portion 36. Further, the apex 35A of the block 35 is positioned in the straight pipe portion 34.

Figure 3B:
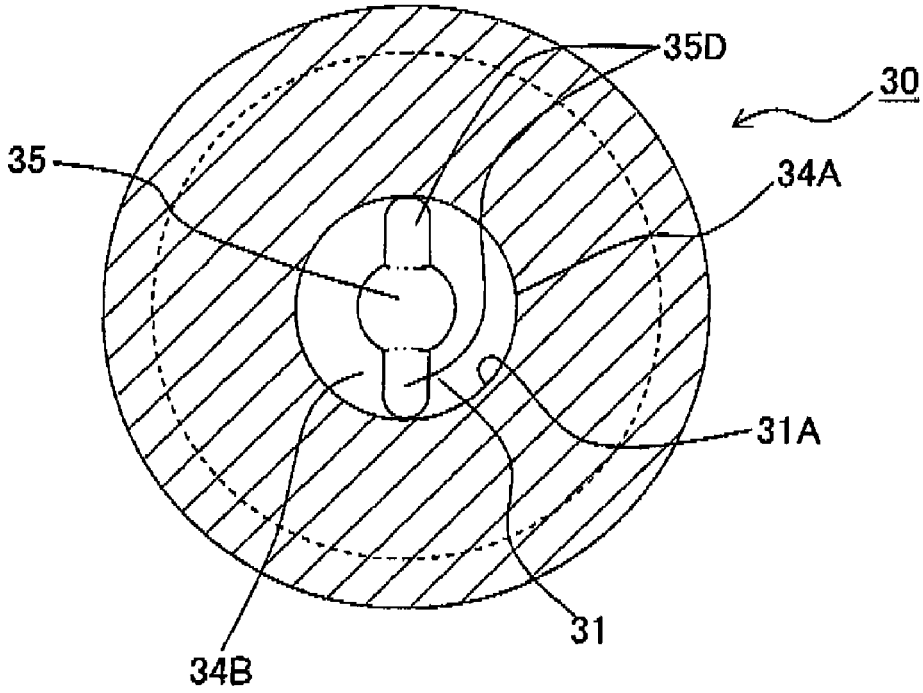
FIG. 3B is a cross-sectional view taken along a line IIIB-IIIB in FIG. 2.

Furthermore, as shown in FIG. 3B, two connecting shafts 35D each formed to be cylindrical-column shaped, are projected (protruded), from the conical surface 35C of the block 35, in mutually opposite directions in the longitudinal direction of the slit-shaped jetting port 33. Front ends of these connecting shafts 35D are fixed in the internal passage 31 at the end portion 34A of the straight pipe portion 34 located on the downstream side.

By the block 35 and the tapered portion 36, a narrowed channel 34B and an expanded portion 37 are formed in the internal passage 31, and the tapered portion 36 is made to be a collision portion against which the aerosol Z passed through the narrowed channel 34 collides. Namely, in the straight pipe portion 34, an area from a position corresponding to the apex 35A of the block 35 up to the end portion 34A on the downstream side is made to be the narrowed channel 34B in which a channel area is narrowed as compared to a channel area on the upstream thereof, and in an area corresponding to the tapered portion 36, an area on the downstream of the bottom surface 35B of the block 35 is made to be the expanded portion 37 in which the channel is expanded than the narrowed channel 34B. Further, a tapered surface 36A of the tapered portion 36 is made to be the collision surface against which the aerosol Z passed through the narrowed channel 34B collides A channel area (cross-sectional area) of the internal passage 31 is narrowed in the narrowed channel 34B gradually from the position corresponding to the apex 35A of the block 35 and is narrowed down to minimum at an interfacial position of the straight pipe portion 34 and the tapered portion 36 (position corresponding to the end portion 36C on the large-diameter side of the tapered portion 36 and the end portion 34A of the straight pipe portion 34; corresponding to a position of line IIIB-IIIB in FIG. 2). Beyond this interfacial position, the channel area is enlarged once but the channel area is narrowed gradually as heading progressively toward the downstream by the tapered surface 36A and the conical surface 35C. Further, beyond the end portion (bottom surface 35B of the cone) of the block 35 and entering into the expanded portion 37, the channel area is enlarged suddenly. The channel area, at the position where the channel is narrowed to the minimum in the narrowed channel 34B, is made to be not more than 50% of a channel area at a position at the upstream thereof.

Further, an inclination angle θ2 of the tapered surface 36A mentioned above is set to be in a range of 45° to 60° with respect to the direction of the flow of the aerosol passed through the narrowed channel 34B disposed immediately in front of (upstream of) the tapered portion 36, namely with respect to a direction along the generating line which forms the conical surface 35C of the block 35.

A throttle portion 38 in which the channel is narrowed gently toward the downstream side is provided at a position somewhat downstream of the expanded portion 37 in the internal passage 31. This throttle portion 38 is eventually narrowed to be slit shaped same as the jetting port 33, and a channel (passage) from a terminal end (upper end portion) of the throttle portion 38 up to the jetting port 33 is made to be a front end passage 39 which width is thin and which has a cross-sectional shape same as the shape of the jetting port 33. The front end passage 39 is formed such that a length of the front end passage 39 is 20 mm to 30 mm. An narrowing amount (throttling amount) of the channel in the throttle portion 38 is set in the internal passage 31 such that a cross-sectional area at a terminal end position (equivalent to opening area of the jetting port 33) is not more than ⅓ of a cross-sectional area of an inlet 38A of the throttle portion 38, namely, not more than ⅓ of a cross-sectional area at a throttle-start position. Accordingly, the aerosol is accelerated sufficiently, and jetted from the jetting port 33.

An inner-wall surface 31A of the internal passage 31 is made to be a smooth surface having a surface roughness of not more than RZ 0.3 μm, and accordingly the material particles M are prevented from adhering to the inner-wall surface 31A.

Next, an explanation will be given as below about an operation and a principle of the film forming apparatus and the jetting nozzle of the first embodiment structured as mentioned above.

At the time of forming a film of the material particles M by using the film forming apparatus 1, firstly, the substrate B is set in the stage 21. Next, the material particles M are charged into the aerosol chamber 11. As the material particles M, for example, lead zirconate titanate (PZT) which is a piezoelectric material can be used.

Further, the carrier gas is introduced from the gas cylinder G so that the material particles M are made to rise up by gas pressure. At the same time, the aerosol chamber 11 is vibrated by the vibration unit 12, thereby mixing the material particles M with the carrier gas to generate the aerosol Z. Further, the inside of the film forming chamber 20 is decompressed by the vacuum pump P to generate pressure difference between the aerosol chamber 11 and the film forming chamber 20. Due to the pressure difference, the aerosol Z enters into the internal passage 31 of the jetting nozzle 30 from the supply pipe 14. In FIG. 2, the flow of the aerosol z is indicated by arrows.

A flow velocity of the aerosol Z, which has entered into the internal passage 31 of the jetting nozzle 30, is increased while passing through the narrowed channel 34B formed by providing the block 35, and the aerosol Z with the increased flow velocity flows in a direction along the conical surface 35C, and strikes or collides against the tapered surface 36A of the tapered portion 36 provided on the downstream of the flow. At this time, among the material particles M contained in the aerosol Z, fine particles having a small mass are turned around along the tapered surface 36A of the tapered portion 36, and are flowed toward the downstream side, but aggregated particles having a comparatively larger mass cannot easily change the flow direction because of a large inertial force, collide against the tapered portion 36, and thus are crushed. Thus, since the aggregated particles are crushed and are supplied in the form of fine particles, it is possible to form a thin and uniform film on the substrate B. At this time, by utilizing the tapered surface 36A inclined with respect to the direction of the flow of the aerosol Z for the purpose of crushing the aggregated particles, it is possible to prevent problem or inconvenience such that the material particles M adhere to the tapered portion 36 due to excessively great collision energy of the material particles M, the material particles M deposit on the tapered portion 36 upon being blown due to stagnation of the aerosol, and the like.

The channel area of the narrowest portion in the narrowed channel 34B is made to be not more than 50% of the channel area at a position on the upstream of the narrowed channel 34B. Accordingly, it is possible to sufficiently accelerate the aerosol Z passing through the narrowed channel 34B such that the aerosol Z collides against the tapered surface 36A with the collision energy sufficient to crush the aggregated particles. Further, it is preferable that the inclination angle of the tapered surface 36A is small to an extent such that the above-mentioned problem can be suppressed. However, when the inclination angle is too small, there is a fear that the collision energy of the aggregated particles with respect to the tapered surface 36A becomes small and the aggregated particles are not crushed sufficiently. Therefore, the angle of inclination θ2 is set to be 45° to 60° with respect to the direction of the flow of the aerosol Z (direction along the generating line forming the conical surface 35C of the block 35).

Furthermore, by arranging the block 35 in a posture such that the conical apex 35A is directed downwardly (toward the upstream side), the conical surface 35C, which is a surface facing the flow of the aerosol Z, is made to be inclined with respect to the flow of the aerosol Z. Accordingly, it is possible to prevent the problem such that the material particles M adhere to the block 35 due to excessively great collision energy of the material particles M, the material particles M deposit on the surface of the block 35 upon being blown due to stagnation of the aerosol, and the like. It is preferable that the inclination angle θ1 is small to an extent such that the above-mentioned problem can be suppressed. However, when the angle is made too small, it is necessary to have a narrowing amount of the channel as required, in other words, since it is necessary to secure a (sufficient) projection length of the conical surface 35C in a direction intersecting the direction of the flow of the aerosol Z, which in turn requires the block 35 as a whole to have a large size. Therefore, the inclination angle θ1 is set to be 30° to 60° with respect to the direction of the flow of the aerosol Z (direction in which the central axis line L of the internal passage 31 is extended).

The aerosol Z, which has passed through the narrowed channel 34B, reaches to the expanded portion 37 which is provided on the downstream of the narrowed channel 34B. In the expanded portion 37, a turbulent flow is developed due to sudden widening of the channel for the aerosol Z, and crushed fragments of the aggregated particles generated due to the collision against the tapered portion 36 are mixed. Accordingly, it is possible to make a concentration of the aerosol Z uniform.

In the first embodiment, the collision portion for crushing the material particles M and the expanded portion 37 for mixing are formed by a simple structure constructed of the tapered portion 36 and the block 35. In other words, the tapered surface 36A of the tapered portion 36 is made to be the collision surface for crushing the aggregated particles M, and an area which is included in the area expanded by the tapered portion 36 and in which the block 35 is absent (area on the downstream of the bottom surface 35B of the block 35) becomes the expanded portion 37. Accordingly, it is possible to crush the aggregated particles while avoiding complication of the structure of the jetting nozzle 30, and to form a uniform film.

The aerosol Z which has passed through the expanded portion 37 is advanced to the throttle portion 38 on the further downstream side. In the throttle portion 38, by narrowing the channel area eventually to not more than ⅓ of the channel area of the inlet 38A, it is possible to sufficiently accelerate the aerosol Z of which the velocity has been decreased once in the expanded portion 37, thereby imparting the collision energy to the material particles M sufficient for the adhesion to the substrate B.

The aerosol Z which has passed through the throttle portion 38 and the front end passage 39 is jetted from the jetting port 33. The material particles M included in the jetted aerosol Z are collided against the substrate B and deposited on the substrate B, thereby forming a film.

Thus, according to the first embodiment, by crushing, in the jetting nozzle 30, once again the large aggregated particles generated by re-aggregation while moving from the aerosol chamber 11 up to the jetting nozzle 30, it is possible to form a thin and uniform film.

Second Embodiment

Figure 4:
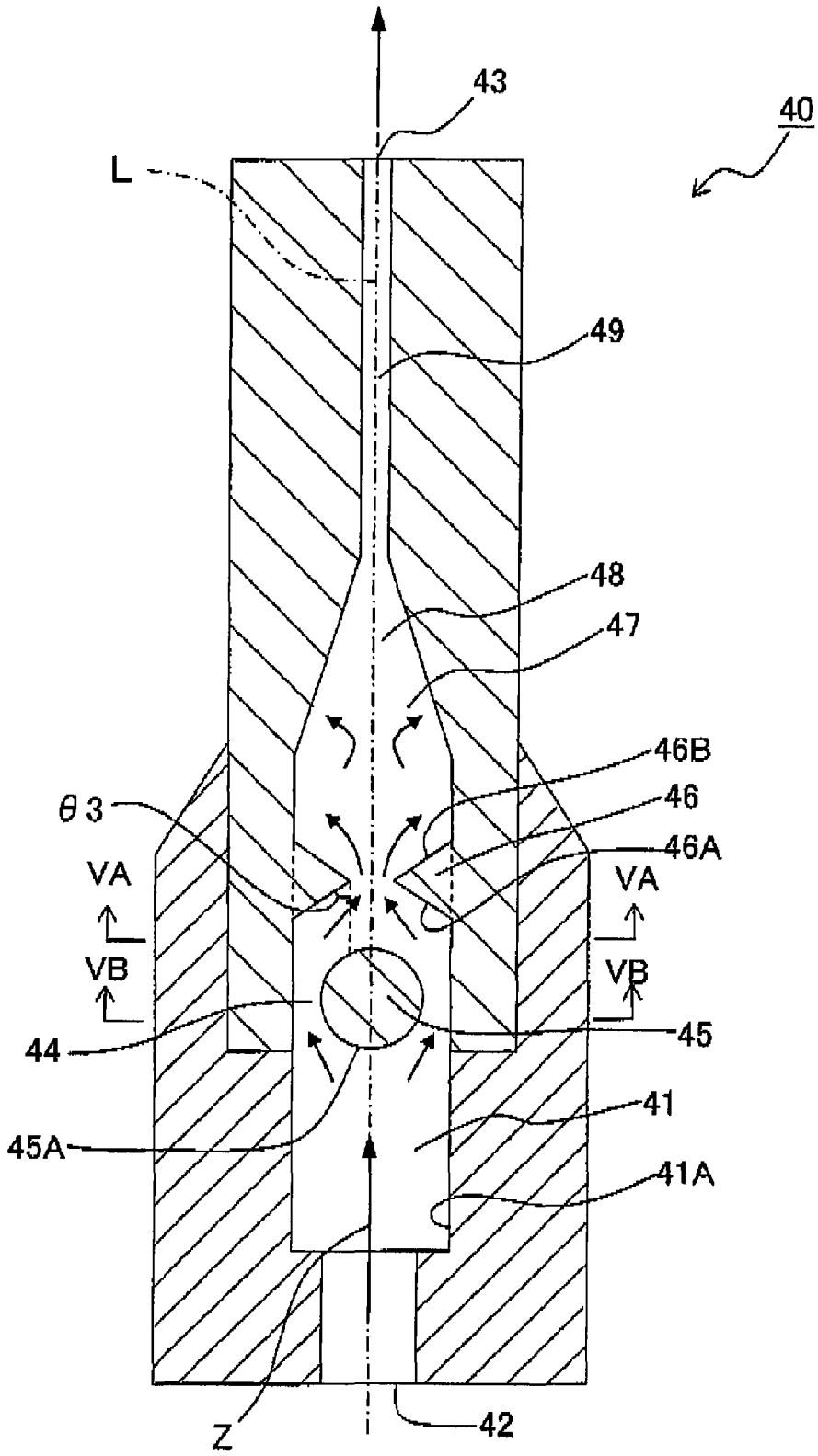
FIG. 4 is side cross-sectional view of a jetting nozzle of a second embodiment.
Figure 5A:
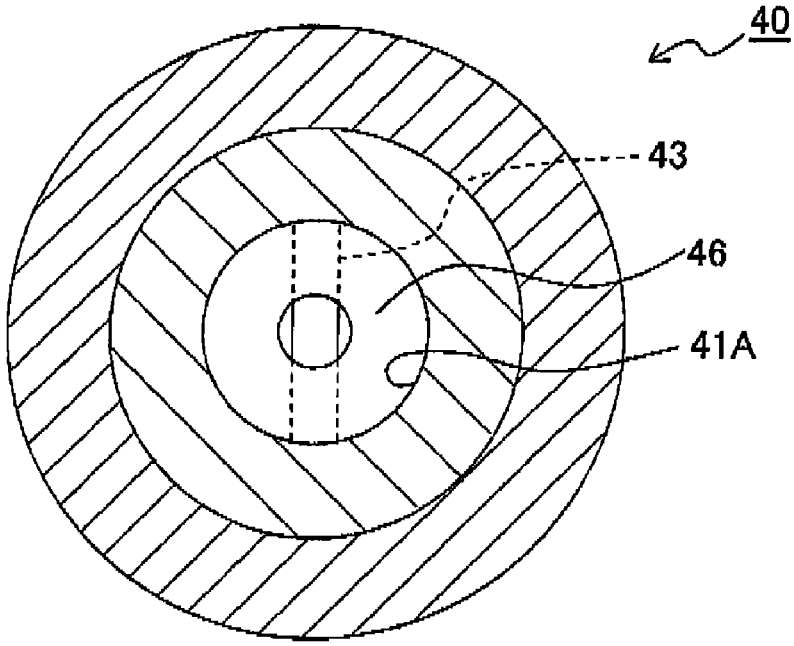
FIG. 5A is a cross-sectional view taken along a line VA-VA in FIG. 4.
Figure 5B:
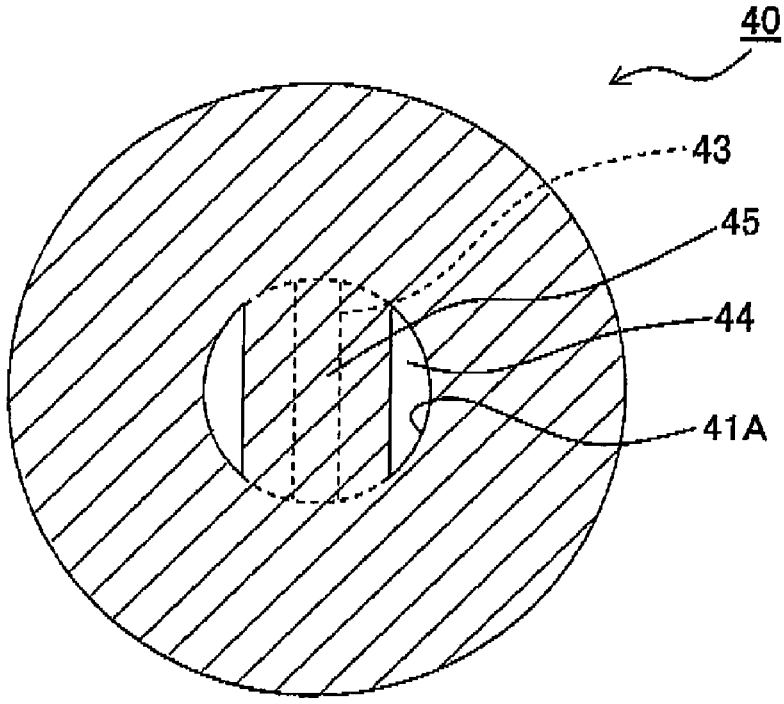
FIG. 5B is a cross-sectional view taken along a line VB-VB in FIG. 4.

A second embodiment of the present invention will be explained as below with reference to FIG. 4 and FIG. 5. The second embodiment differs from the first embodiment mainly in that, in the second embodiment, a surface facing the flow of the aerosol 2 in a block 45 is a circular-arc shaped surface, and that a collision portion 46 is formed to project in an internal passage 41. Same reference numerals are designed to part or component same as those in the first embodiment, and the explanation therefor is omitted.

A jetting nozzle 40 of the second embodiment is used in the film forming apparatus 1 similarly as in the first embodiment. The jetting nozzle 40 is formed to be circular cylindrical shaped and having the internal passage 41 formed therein in a similar manner as in the first embodiment. An opening on a side of a lower end of the internal passage 41 defines a supply port 42, and an opening on a side of an upper end of the internal passage 41 defines a jetting port 43 which is slit-shaped.

A block 45 (obstacle, obstacle member) is provided in the internal passage 41 of the jetting nozzle 40, at a position somewhat above the supply port 42 (at a position on the downstream of the supply port 42). The block 45 is formed to be circular-pillar shaped, and arranged in a posture such that the axial direction of the circular pillar is along the longitudinal direction of the slit of the jetting port 43, and that a center position in the radial direction is positioned on a central axis line L of the internal passage 41. In other words, a central axis line of the block 45 is orthogonal to the central axis line of the internal passage 41.

Further, a surface of the block 45 facing the flow of the aerosol Z is an outer peripheral surface 45A of the circular pillar, namely a circular-arc shaped surface expanded toward the upstream side. It is preferable that a channel area of the narrowed channel 44 at a position where the channel is the narrowest (corresponding to a position of a line VB-VB in FIG. 4) is made to be not more than 50% of a channel area at a position upstream of this narrowed channel 44 for a reason similar as in the first embodiment.

Both end portions in an axial direction of the block 45 are fixed to an inner-wall surface 41A of the internal passage 41.

Further, a collision portion 46 is provided in the internal passage 41 at a position somewhat above the block 45. This collision portion 46 is formed to be annular shaped projecting toward a central axis line L throughout the entire circumference (periphery) of the internal passage 41. A lower-side surface 46A of this collision portion 46 is made to be an inclined surface rising toward the central axis line L, and an upper-side surface 46B of this collision portion 46 is made to be an inclined surface lowering toward the inner side of the internal passage 14. It is preferable that an inclination angle θ3 of the lower-side surface 46A, as a collision surface against which the aerosol Z collides, is set to be 45° to 60° with respect to the direction of the flow of the aerosol Z (direction in which the central axis line L is extended) for a reason similar as in the first embodiment.

In the internal passage 41, at a position downstream of the collision portion 46, a throttle portion 48 and a front end passage 49 similar as in the first embodiment are provided.

At the time of forming a film of the material particles M by using the film forming apparatus 1 provided with the jetting nozzle 40 as described above, the substrate B is set in the stage 21 similarly as in the first embodiment. Further, the aerosol Z is generated in the aerosol chamber 11, and the aerosol z is guided to the jetting nozzle 40. In FIG. 4, the flow of the aerosol Z is indicated by arrows.

A flow velocity of the aerosol Z, which has entered into the internal passage 41 of the jetting nozzle 40, is increased while passing through the narrowed channel 44 which is formed by providing the block 45, and the aerosol 2 strikes or collides against the lower side surface 46A of the collision portion 46 provided at the downstream side of the block 45. Accordingly, it is possible to crush the aggregated particles into fine particles similarly as in the first embodiment. At this time, the block 45 is arranged such that an axial direction of the block 45 is along a longitudinal direction of a slit of the jetting port 43, and that a central position of the block 45 in the radial direction is positioned on the central axis line L of the internal passage 41. Accordingly, since the aerosol Z passes through the narrowed channel 44 while being split (divided) almost uniformly throughout the entire length in the longitudinal direction of the block 45 (coinciding with a longitudinal direction of the jetting port 43), any variation in the flow of the aerosol Z in the longitudinal direction of the jetting port 43 hardly occurs, and thus it is possible to form a uniform film. Further, a facing surface of the block 45, which faces the flow of the aerosol Z, is the outer peripheral surface 45A of the circular-pillar, namely a circular-arc surface expanded toward the upstream of the aerosol flow. Accordingly, similarly as in the first embodiment in which the facing surface is an inclined surface (conical surface 35C), it is possible to prevent problem or inconvenience such that the material particles M adhere to the block 45 due to excessively great collision energy of the particles, the particles deposit on the surface of the block upon being blown due to stagnation of the aerosol, and the like.

Further, in an area at downstream of the collision portion 46 and at upstream of the throttle portion 48, any member which would obstruct the flow of the aerosol Z is not particularly provided in the internal passage 41. Accordingly, this area functions as an expanded portion 47 having a channel area relatively wider as compared to the narrowed channel 44. In this expanded portion 47, a turbulent flow is developed due to sudden widening of the channel, and crushed fragments of the particles crushed by the collision against the collision portion 46 are mixed, similarly as in the first embodiment. Accordingly, it is possible to make the concentration of the aerosol Z uniform.

The aerosol Z which has passed through the expanded portion 47 is passed through the throttle portion 48 and the front end passage 49, and jetted through the jetting port 43, similarly as in the first embodiment. The material particles M included in the jetted aerosol Z are collided against the substrate B and deposited on the substrate B, thereby forming a film.

Thus, according to the second embodiment, by crushing, in the jetting nozzle 40, once again large aggregated particles generated by re-aggregation of the particles while moving from the aerosol chamber 11 up to the jetting nozzle 40, it is possible to form a thin and uniform film. Further, the block 45 is formed along the longitudinal direction of the slit of the jetting port 43. Accordingly, any variation in the flow of the aerosol Z hardly occurs throughout the entire length in the longitudinal direction of the slit, and thus it is possible to form a further uniform film.

Third Embodiment

Figure 6:
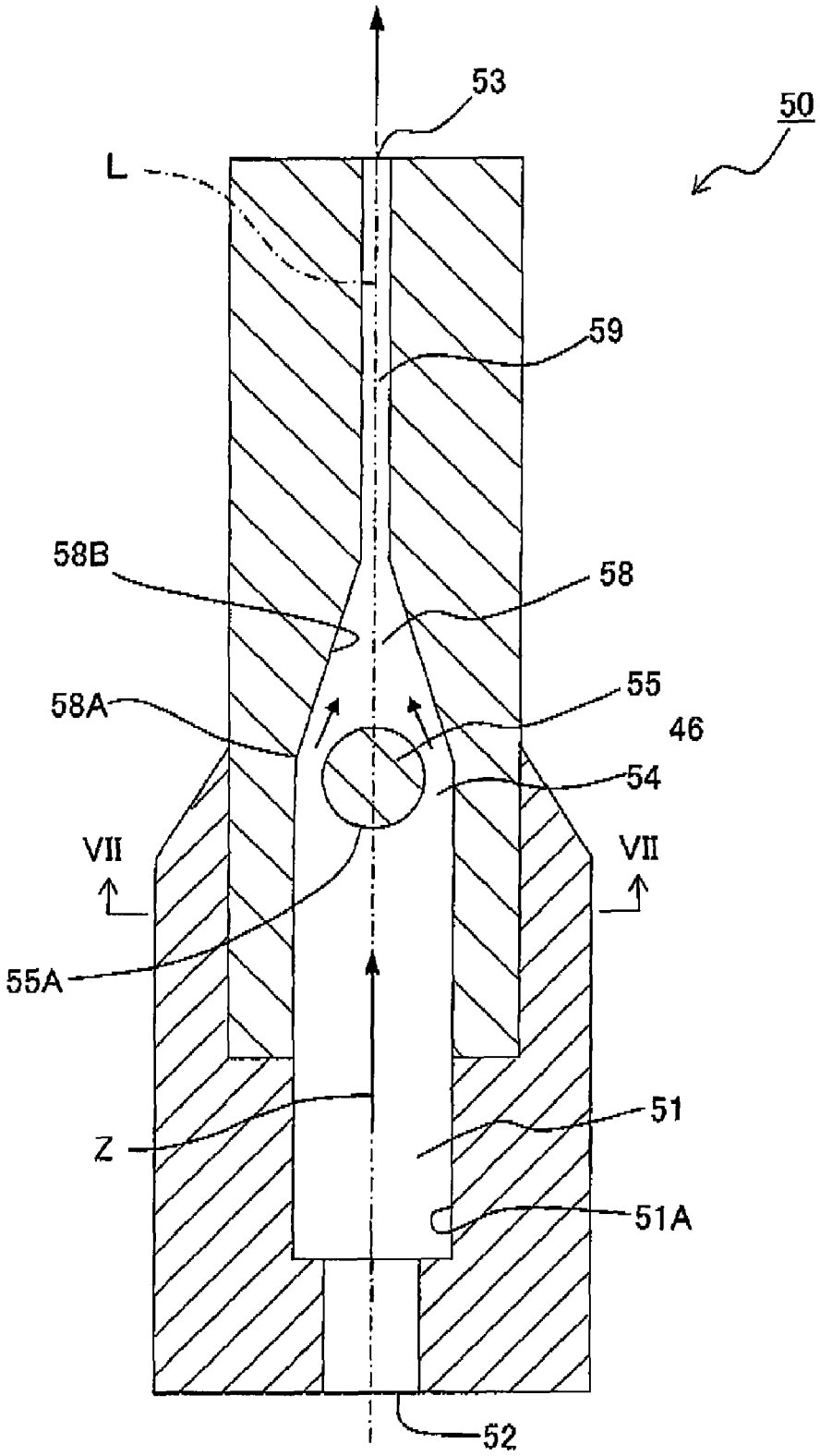
FIG. 6 is a side cross-sectional view of a jetting nozzle of a third embodiment.
Figure 7:
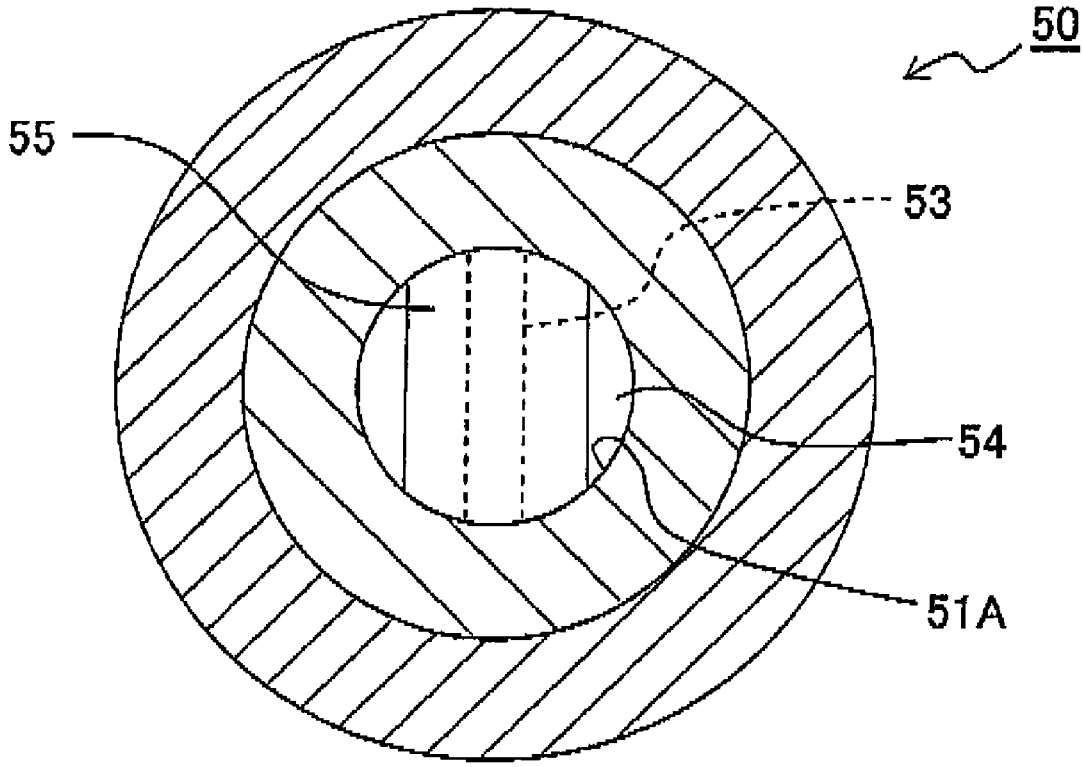
FIG. 7 is a cross-sectional view taken along a line VII-VII in FIG. 6.

A third embodiment of the present invention will be explained as below with reference to FIG. 6 and FIG. 7. The third embodiment differs from the first embodiment mainly in that in the third embodiment, an inner-wall surface 58B of a throttle portion 58 is made to be a collision surface by providing a block 55 at an inlet of the throttle portion 58. Same reference numerals are designated for structures (parts or components) which are similar as in the first embodiment, and the explanation therefor will be omitted.

A jetting nozzle 50 of the third embodiment can be used in a film forming apparatus 1 which is similar as that in the first embodiment. The jetting nozzle 50 is formed to be circular-cylindrical shaped and includes an internal passage 51 formed therein similarly as in the first embodiment. An opening on a side of a lower end of the internal passage 51 defines a supply port 52, and an opening on a side of an upper end of the internal passage 51 defines a jetting port 53. A throttle portion 58 and a front end passage 59 are provided on a downstream side in the internal passage 51 of the jetting nozzle 50, similarly as in the first embodiment.

At an inlet 58A of the throttle portion 58, a narrowed channel 54 is provided by arranging a block 55 at the inlet 58A. This block 55, similarly as in the second embodiment, is formed to be circular-pillar shaped, and is arranged (installed) such that an axial direction of the circular pillar is along a longitudinal direction of a slit of the jetting port 53, and a central position in a radial direction of the circular pillar is positioned to be orthogonal to a central axis line L of the internal passage 51; and that a facing surface of the block 55 which faces the flow of the aerosol Z is an outer peripheral surface 55A of the circular pillar, namely a circular-arc shaped surface expanded toward the upstream. Both end portions in the axial direction of the block 55 are fixed to an inner-wall surface 51A of the internal passage 51. It is preferable that a channel area of the narrowed channel 54 at a position where the channel is the narrowest is made to be not more than 50% of a channel area at a position upstream of this narrowed channel 54 for a reason similar as in the first embodiment.

At the time of forming a film of the material particles M by using the film forming apparatus 1 provided with the jetting nozzle 50 as described above, the substrate B is set in the stage 21 similarly as in the first embodiment. Further, the aerosol Z is generated in the aerosol chamber 11, and is guided to the jetting nozzle 50. In FIG. 6, the flow of the aerosol Z is indicated by arrows.

A flow velocity of the aerosol Z, which has entered into the internal passage 51 of the jetting nozzle 50, is increased while passing through the narrowed channel 54 formed by providing the block 55, and the aerosol Z enters into the throttle portion 58 provided on the downstream of the narrowed channel 54. Next, the aerosol Z is collided against an inner-wall surface 58B of the throttle portion 58, which is tapered toward the downstream side. Accordingly, the aggregated particles are crushed and turned to fine powder (fine particles) similarly as in the first embodiment. Thus, in the third embodiment, the inner-wall surface 58B of the throttle portion 58 is made to be the collision surface by providing the block 55 at the inlet 58A of the throttle portion 58.

Similarly as in the second embodiment, the block 55 is arranged (installed) such that the axial direction of the block 55 is along the longitudinal direction of the slit of the jetting port 53, and that the central position in the radial direction is positioned on a central axis line L of the internal passage 51. Therefore, any variation in the flow of the aerosol Z hardly occurs throughout the entire length in the longitudinal direction of the jetting port 53, and thus it is possible to form a uniform film. Further, a facing surface of the block 55, which faces the flow of the aerosol Z is the outer peripheral surface 55 A of the circular-pillar, namely a circular-arc surface expanded toward the upstream. Therefore, similarly as in the second embodiment, it is possible to prevent the problem or inconvenience such that the material particles M adhere to the block 55 due to excessively great collision energy of the material particles M, the material particles M deposit on the block 55 upon being blown due to stagnation of the aerosol, and the like.

The aerosol Z which has passed through the throttle portion 58 and the front end passage 59 is jetted through the jetting port 53. The material particles M included in the jetted aerosol Z are collided against the substrate B and deposited on the substrate, thereby forming a film.

Thus, according to the third embodiment, by crushing, in the jetting nozzle 50, once again large aggregated particles generated by re-aggregation of the particles while moving from the aerosol chamber 11 up to the jetting nozzle 50, and thus it is possible to form a thin and uniform film. Further, the inner-wall surface 58B of the throttle portion 58 is utilized or employed as the collision surface by providing the block 55 at the inlet 58A of the throttle portion 58. Therefore, there is no need to provide the collision surface separately. Accordingly, it is possible to crush the aggregated particles while avoiding complication of the structure of the jetting nozzle 50, and to form a uniform film.

Other Embodiments

The technical scope of the present invention is not intended to be limited to the embodiments as described above. For example, the following configurations are also included in the technical scope of the present invention. Furthermore, the technical scope of the present invention also encompasses the range of equivalents.

Figure 8:
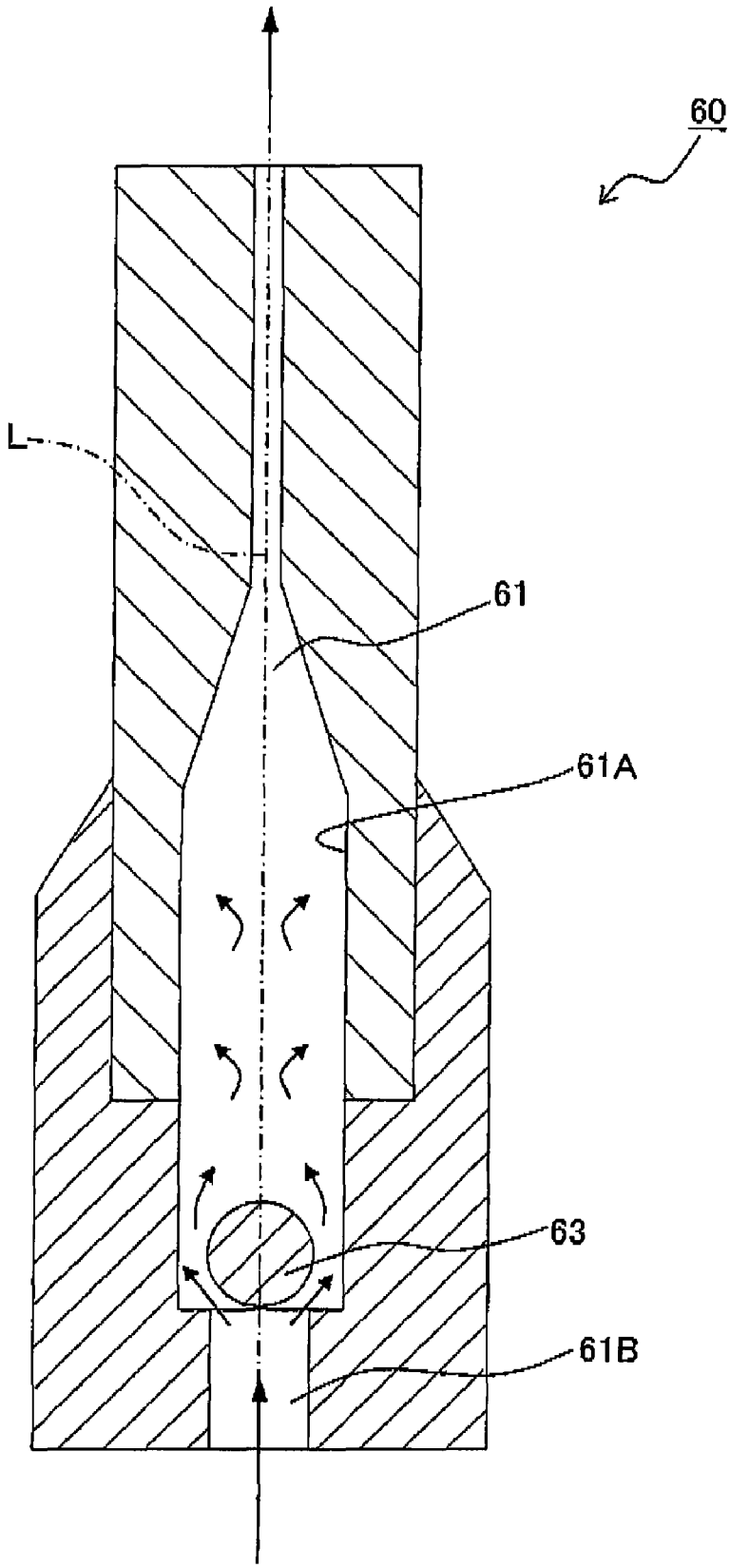
FIG. 8 is a side cross-sectional view of a jetting nozzle of another embodiment.
Figure 9:
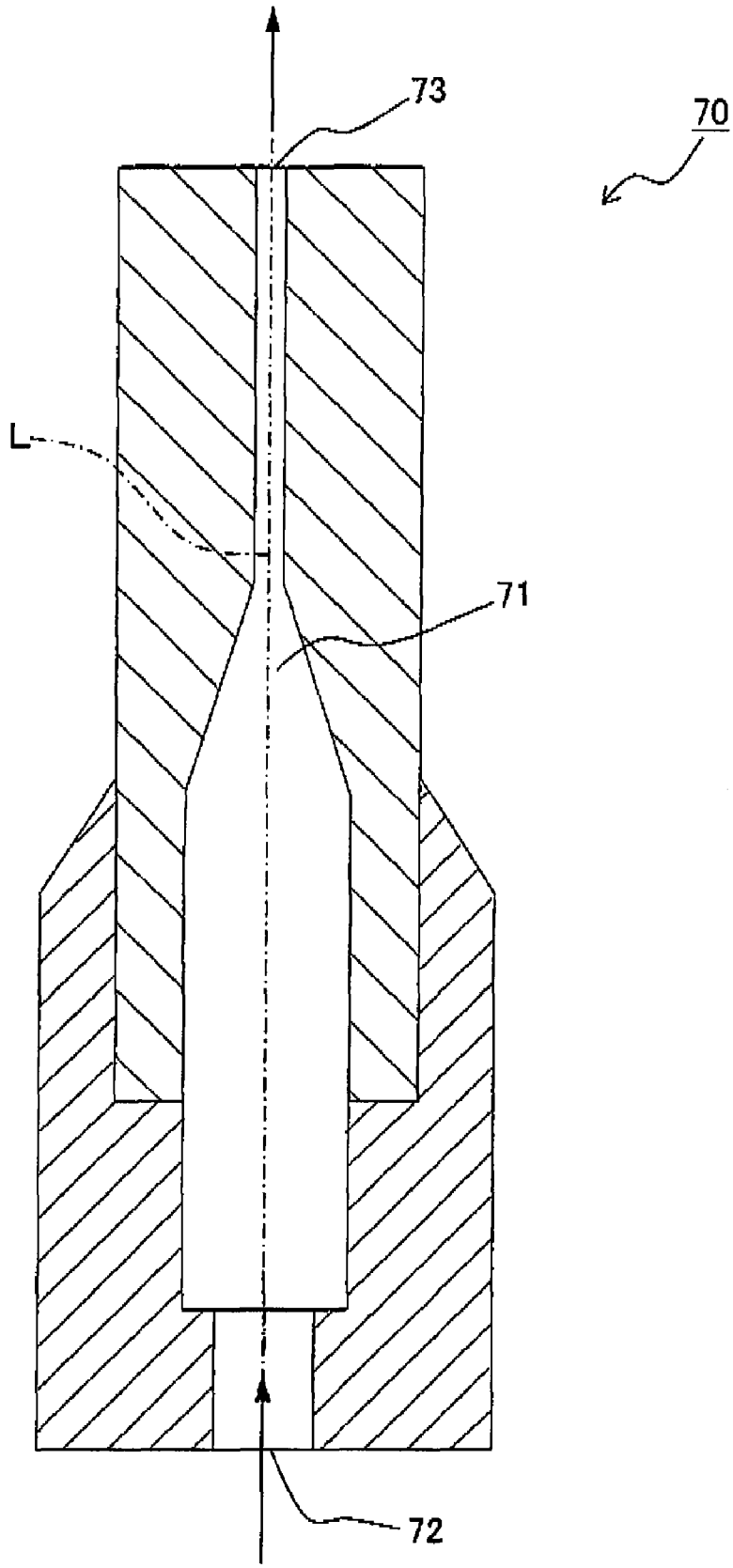
FIG. 9 is a side cross-sectional view of a conventional jetting nozzle.

For example, as in a jetting nozzle 60 shown in FIG. 8, a portion, of an internal passage 61, on the upstream of a position at which a block 63 of the internal passage 61 is arranged, may be structured as a small-diameter portion 61B in which a diameter of a channel cross-sectional area is small, and an inner-wall surface 61 of the internal passage 61 may be utilized as the collision portion by making an inner diameter (diameter of a channel cross-section) of the small-diameter portion 61B to be substantially same as or smaller than a diameter of a cross-sectional circle of the block 63. In other words, by making the portion, which is on the upstream of the position at which the block 63 is arranged, to be the small diameter portion 61B, all the aerosol Z flowing through this small diameter portion 61B is turned around the block 63 to become a flow inclined to some extent toward an outer circumference of the internal channel 61, and the aerosol Z collides against the inner wall surface 61A of the internal channel 61. According to such as structure, it is possible to make almost all the aerosol Z flowing through the internal passage 61 collides assuredly against the inner-wall surface 61A, and to improve a crushing effect of the aggregated particles.

A shape of the obstacle member is not necessarily limited to the circular-pillar shape or the circular-conical shape as described in the embodiments, and may be have a petrosal shape such as a quadrangular-pyramid shape, and a triangular-pyramid shape; or may be a spherical shape; or may be a pillar shape such as a square-pillar shape, a triangular-pillar shape, or the like.

In the embodiments described above, lead zirconate titanate (PZT), which is a piezoelectric material, is used as material particles. However, a type of material particle is not limited in particular, provided that the material is usable in film forming by the aerosol deposition method. For example, alumina, which is an insulating material, may also be used.

In the first embodiment, two connecting shafts 35D are provided. However, not less than 3 pieces of the connecting shafts may be provided. In this case, it is preferable that the connecting shafts are projected (protruded) at an equal pitch along an external peripheral direction of the block.

What is claimed is:

1. A film forming apparatus comprising:

an aerosol generating section which generates an aerosol by dispersing particulate material in a carrier gas;

a jetting nozzle having an internal passage which is formed in the jetting nozzle and through which the aerosol flows, the internal passage having one end defining a supply port which receives a supply of the aerosol from the aerosol generating section and having other end defining a jetting port from which the aerosol is jetted toward a process-objective material;

a narrowed channel which is provided in the internal passage and which has a channel area narrower than a channel area on an upstream of the narrowed channel;

a collision portion which is provided in the internal passage on a downstream of the narrowed channel, and against which a flow of the aerosol passed through the narrowed channel collides;

an obstacle member; and a front end passage provided in the internal passage downstream from the collision portion, wherein the front end passage is in fluid communication with the jetting port, wherein the collision portion surrounds a portion of the obstacle member.

2. The film forming apparatus according to claim 1, wherein a collision surface, of the collision portion, which faces the flow of the aerosol is an inclined surface inclined with respect to a direction of the flow of the aerosol.

3. The film forming apparatus according to claim 2, wherein an angle of inclination of the collision surface is 45° to 60° with respect to the direction of the flow of the aerosol.

4. The film forming apparatus according to claim 1, wherein the channel area of the narrowed channel in the internal passage is not more than 50% of a channel area at a position of the internal passage upstream of the narrowed channel.

5. The film forming apparatus according to claim 1, wherein: a throttle portion, at which a channel is narrowed toward the jetting port, is provided in the internal passage on a downstream of the collision portion; and an opening area of the jetting port is not more than ⅓ of a channel area of an inlet of the throttle portion.

6. The film forming apparatus according to claim 5, wherein the narrowed channel is formed by providing the obstacle member, which obstructs the flow of the aerosol, in the internal passage.

7. The film forming apparatus according to claim 6, wherein a facing surface, of the obstacle member, which faces the flow of the aerosol is an inclined surface inclined with respect to a direction of the flow of the aerosol.

8. The film forming apparatus according to claim 7, wherein an angle of inclination of the facing surface is 30° to 60° with respect to the direction of the flow of the aerosol.

9. The film forming apparatus according to claim 6, wherein the facing surface in the obstacle member is an arc-shaped surface expanded toward upstream of the flow of the aerosol.

10. The film forming apparatus according to claim 6, wherein the obstacle member is provided on a central axis line of the internal passage.

11. The film forming apparatus according to claim 6, wherein the obstacle member is column-shaped.

12. The film forming apparatus according to claim 6, wherein the jetting port is formed in a slit shape, and the obstacle member is formed along a longitudinal direction of the jetting port.

13. The film forming apparatus according to claim 6, wherein the jetting port is formed in a slit shape, and a supporting member supporting the obstacle member is extended in a longitudinal direction of the jetting port.

14. The film forming apparatus according to claim 6, wherein the obstacle member is provided at an inlet of the throttle portion, and the collision surface is an inner-wall surface of the throttle portion.

15. The film forming apparatus according to claim 1, wherein an expanded portion, at which a channel area is widened than that of the narrowed channel, is provided in the internal passage on the downstream of the narrowed channel.

16. The film forming apparatus according to claim 6, wherein an inner-wall surface of the internal passage, which surrounds the obstacle member, is tapered toward downstream of the flow of the aerosol.

17. The film forming apparatus according to claim 1, wherein a surface roughness of an inner-wall surface of the internal passage is not more than RZ 0.3 μm.

18. A jetting nozzle usable in a film forming apparatus including an aerosol generating section which generates an aerosol by dispersing particulate material in a carrier gas, the jetting nozzle comprising:

an internal passage which is formed in the jetting nozzle and through which the aerosol flows, the internal passage having one end defining a supply port which receives a supply of the aerosol from the aerosol generating section and having other end defining a jetting port from which the aerosol is jetted toward a process-objective material;

a narrowed channel which is provided in the internal passage and which has a channel area narrower than a channel area on an upstream of the narrowed channel;

a collision portion which is provided in the internal passage on a downstream of the narrowed channel, and against which a flow of the aerosol passed through the narrowed channel collides;

an obstacle member; and a front end passage provided in the internal passage downstream from the collision portion, wherein the front end passage is in fluid communication with the jetting port, wherein the collision portion surrounds a portion of the obstacle member.

19. The jetting nozzle according to claim 18, wherein the narrowed channel is formed by providing the obstacle member, which obstructs the flow of the aerosol, in the internal passage.

20. The jetting nozzle according to claim 19, wherein the jetting port is formed to be slit shaped, and the obstacle member is formed along a longitudinal direction of the jetting port.

21. The film forming apparatus according to claim 1, wherein a ratio of a length of the front end passage with respect to a length of the internal passage is in a range of 20/100 to 30/70.

22. The film forming apparatus according to claim 21, wherein the length of the front end passage is in a range of 20 mm to 30 mm.

23. The film forming apparatus according to claim 1, wherein the front end passage has a cross-sectional shape which is substantially the same as the shape of the jetting port.

24. The jetting nozzle according to claim 18, wherein a ratio of a length of the front end passage with respect to a length of the internal passage is in a range of 20/100 to 30/70.

25. The jetting nozzle according to claim 24, wherein the length of the front end passage is in a range of 20 mm to 30 mm.

26. The jetting nozzle according to claim 18, wherein the front end passage has a cross-sectional shape which is substantially the same as the shape of the jetting port.

* * * * *